United States Patent [19]

Nishio et al.

[11] Patent Number: 4,804,153

[45] Date of Patent: Feb. 14, 1989

[54] METHOD AND APPARATUS FOR WITHDRAWING LONG-SIZED OBJECTS

[75] Inventors: Masanobu Nishio; Kazuo Sawada; Kazuhisa Yamauchi; Saburo Yosimura, all of Osaka, Japan

[73] Assignee: Sumitomo Electric Industries, Ltd., Osaka, Japan

[21] Appl. No.: 31,560

[22] PCT Filed: Jun. 24, 1986

[86] PCT No.: PCT/JP86/00318

§ 371 Date: Feb. 17, 1987

§ 102(e) Date: Feb. 17, 1987

[87] PCT Pub. No.: WO87/00155

PCT Pub. Date: Jan. 15, 1987

[30] Foreign Application Priority Data

Jun. 26, 1985 [JP] Japan ..... 60-139718

[51] Int. Cl.[4] ..... B21C 47/02; B22D 11/00

[52] U.S. Cl. ..... 242/78.1; 242/74.1; 164/463; 164/483

[58] Field of Search ..... 242/78.1, 74, 74.1, 242/78, 78.3; 72/289; 164/463, 483

[56] References Cited

U.S. PATENT DOCUMENTS 4,617,993 10/1986 Tsubata et al. ..... 164/463

FOREIGN PATENT DOCUMENTS 52-100979 7/1977 Japan .
56-71562 6/1981 Japan .
56-103044 8/1981 Japan .
59-16656 1/1984 Japan .
59-230967 12/1984 Japan .

*Primary Examiner*—Stuart S. Levy
*Assistant Examiner*—Steven M. duBois
*Attorney, Agent, or Firm*—W. G. Fasse; D. H. Kane, Jr.

[57] ABSTRACT

A method and apparatus for continuously withdrawing an elongated product such as from a melt a fine wire is based on the rotating liquid medium spinning method. A layer of cooling liquid (14) is centrifugally formed on the inner peripheral surface of a rotational drum (13). Disposed inside the rotational drum (13) is a winding reel (19) having a rotating winding peripheral surface (18). A holder element (20) adapted to be magnetically attracted to the winding peripheral surface (18) is initially placed on the inner peripheral surface of the rotational drum (13). A molten material injected into the drum by a nozzle (16) is quenched for solidification in the cooling liquid (14) to form the product. Initially, the leading end emerging from the nozzle rides over the holder element (20) which then carries the leading end onto the winding peripheral surface (18) and holds it thereon by magnetic attraction. The product (17) is then wound on the winding peripheral surface (18) with its portion fixed by the holder element (20) serving as the winding starting end.

14 Claims, 3 Drawing Sheets

METHOD AND APPARATUS FOR WITHDRAWING LONG-SIZED OBJECTS

TECHNICAL FIELD

This invention relates to a method and apparatus for withdrawing long-sized or elongated objects, particularly a method and apparatus by which a fine metal wire, for example, obtained by injecting molten metal through a nozzle and quenching it for solidification, is withdrawn by winding the wire.

BACKGROUND ART

It is known to melt a metal or alloy and inject it as a fine stream into a rotating cooling liquid to thereby produce a fine wire. This method is called "In-Rotating-Water Spinning Method" and is disclosed, for example, in Japanese Patent Application Laying-Open No. 64948/1980.

In the "In-Rotating-Water Spinning Method" mentioned above, since a fine wire can be obtained directly from a molten state, a fine wire of even a hard-to-work material can be easily obtained without requiring so much energy.

However, the "In-Rotating-Water Spinning Method" has presented the problem that the fine wire centrifugally retained in the inner peripheral surface of the rotating drum, is very difficult to withdraw from the drum with a satisfactory efficiency. For example, to collect the fine metal wire while continuously operating the rotating liquid medium spinning apparatus, it is necessary to grip the end of the fine wire or a portion thereof adjacent its end, but generally such gripping has been difficult since it is moving at more than several meters per second. Therefore, it has been common practice to take out the fine wire after the rotation of the rotating drum is stopped.

On the other hand, it has generally been also difficult for the same reason to withdraw during operation such a long-sized object as a metal tape quenched for solidification by a roll quenching method.

In addition, a method which utilizes magnetic force for withdrawing a non-crystalline quenched tape while the latter is being continuously produced is disclosed in Japanese Patent Application Laying-Open No. 94453/1982, which suggests that the non-crystalline tape after being solidified, be continuously wound on a magnetized winding drum by magnetically attracting said tape.

However, the aforesaid suggested method presents the problem that the elongated objects to be withdrawn are limited to magnetic materials.

SUMMARY OF THE INVENTION

Thus, the invention is intended to provide a method and apparatus which makes it possible to efficiently and reliably withdraw elongated objects regardless of whether they are made of magnetic or non-magnetic materials.

The method of withdrawing elongated objects according to the invention uses a means in which, with an elongated object passing between a winding peripheral surface which is rotating magnetically and a effective holder element magnetically attracted to said winding peripheral surface, the holder element is magnetically attracted to the winding peripheral surface to thereby fix a portion of the elongated object to the winding peripheral surface, whereupon, with said fixed portion of the elongated object used as the winding starting end, the elongated object is wound on the winding peripheral surface.

In addition, to magnetically attract the holder element to the winding peripheral surface, as described above, either the holder element or the winding peripheral surface is formed as a magnet and the other is formed of a ferromagnetic material.

In a method of withdrawing elongated objects according to a preferred embodiment of the invention, an elongated object placed on the inner peripheral surface of a rotating cylindrical drum and running with the rotation of said drum, is wound on the winding peripheral surface of a winding reel having an axis which is disposed at a position within the drum and off its center, said axis is extending in parallel to the axis of the drum and rotating in the same direction as the drum, for withdrawing the elongated object. Such withdrawing method comprises as its first step, preparing a holder element adapted to be magnetically attracted to the winding peripheral surface; at its second step, placing the holder element on the inner peripheral surface of the rotating cylindrical drum such that it is centrifugally retained thereon; as its third step, positioning the leading end of the elongated object on the holder element; as its fourth step, causing the holder element with the elongated object placed thereon to be attracted to the winding peripheral surface when the holder element passes close by the winding reel; as its fifth step, fixing a portion of the elongated object to the winding peripheral surface by the holder element for winding the elongated object on the winding peripheral surface with said fixed portion of the elongated object used as a winding starting end.

In another preferred embodiment of said withdrawing method, the second step is performed at a position remote from a position close to the winding reel and the third step is performed before the holder element placed in the second step reaches the position close to the winding reel, whereby, the holder element is prevented from being attracted to the winding peripheral drum before it arrests the elongated object. In addition, from the same point of view, in the fourth step, the operation of moving the winding reel toward the inner peripheral surface of the drum may be performed. Further, the magnetic force for attracting the holder element to the winding peripheral surface may be provided by an on-off controlled electromagnet and the latter may be turned on upon completion of the second and third steps.

An apparatus for withdrawing elongated objects according to the invention comprises a path for conveying an elongated object, a winding mechanism disposed on one side of said conveying path and having a rotating winding peripheral surface, and a holder element disposed on the other side of the conveying path and adapted to be magnetically attracted to the winding peripheral surface.

A preferred embodiment of such a withdrawing apparatus further comprises magnetic attraction control means for controlling the magnetic force such that it is not until the elongated object passes between the winding peripheral surface and the holder element, that the magnetic force is sufficient to attract the holder element to the winding peripheral surface. This magnetic attraction control means is implemented by a means which reduces the distance between the winding peripheral surface and the holder element or, in the case where the magnetic force for attracting the holder element to the winding peripheral surface is provided by an electromagnet, it is implemented by a switch means for on-off controlling the electromagnet.

Thus, according to the invention, a an elongated object to be withdrawn is taken up by the holder element adapted to be magnetically attracted to the winding peripheral surface, whereupon it is clamped between the holder element and the winding peripheral surface and fixed to the winding peripheral surface. Therefore, the elongated object, whether it is a magnetic or non-magnetic material, can be reliably wound on the winding peripheral surface for withdrawal. Even if the elongated object is moving longitudinally thereof, the holder element can reliably arrest said object when attracted to the winding peripheral surface, thus making it possible to start the withdrawing operation without stopping the movement of the elongated object.

DETAILED DESCRIPTION OF PREFERRED EXAMPLE EMBODIMENTS AND OF THE BEST MODE FOR CARRYING OUT THE INVENTION

Figure 1:
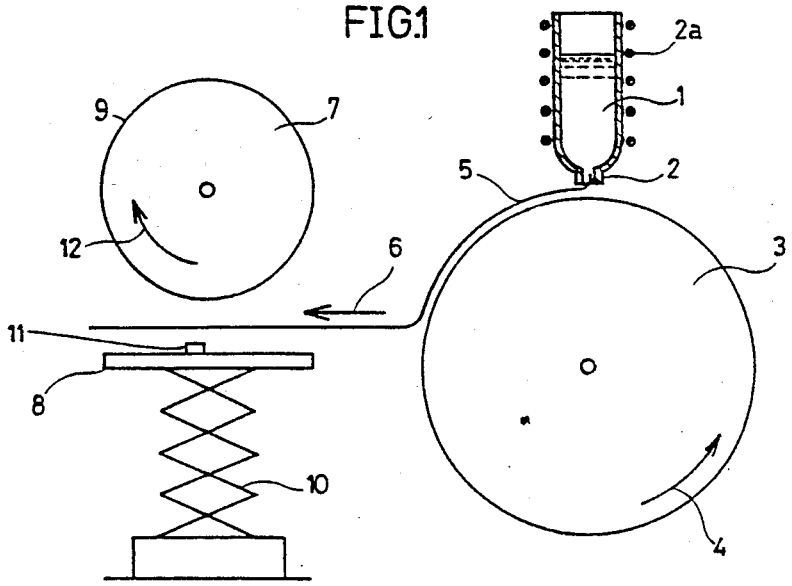
FIGS. 1 and 2 show a first embodiment of the invention, schematically illustrating an apparatus wherein a tape-like solidified object is obtained by the roll quenching method and is withdrawn.
Figure 2:
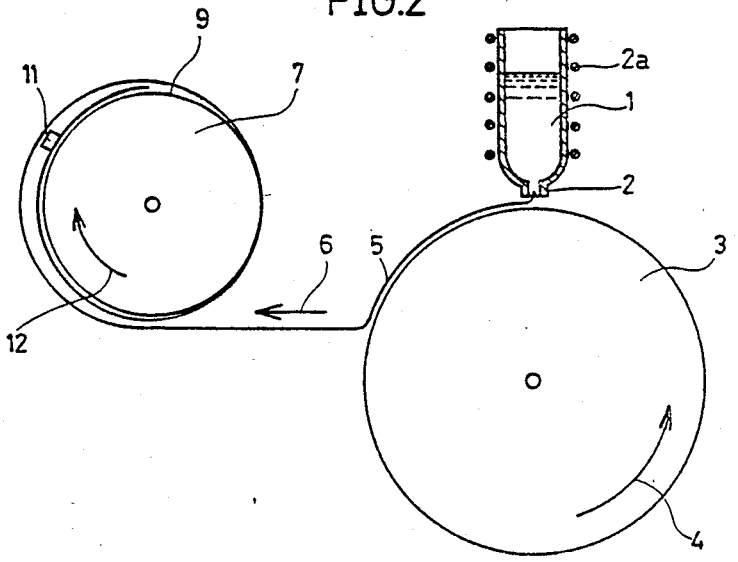

FIGS. 1 and 2 show the invention as applied to the withdrawal of a quenched tape in the roll quenching method.

As shown in FIG. 1, a molten metal 1, such as a Cu-P alloy, is poured onto the peripheral surface of a quenching roller 3 through a nozzle 2 heated by a heater 2*a*. The quenching roller 3 is rotated in the direction of arrow 4, and the molten metal 1 poured out through the nozzle 2 is quenched for solidification on the peripheral surface of the quenching roller 3. To withdraw this tape-like solidified body 5 as a an elongated object, the following arrangement is used.

The tape-like solidified body 5 is taken out in the direction of arrow 6, and in this direction a winding drum 7 is disposed above the path of travel of the tape-like solidified body 5 and a block 8 is disposed below said path. The winding drum 7 has a winding peripheral surface 9 made of a ferromagnetic material, such as an iron-type material. The block 8 is made of non-magnetic material and is held as by a pantograph mechanism 10, whereby it is vertically movable. A magnetically effective holder element 11 made of a permanent magnet is placed in a free state on the block 8. The winding drum 7 is rotated in the direction of arrow 12 at the same speed as that of the quenching roller 3.

Just after the front end of the tape-like solidified body 5 has passed between the winding peripheral surface 9 of the winding drum 7 and the holder element 11, the pantograph mechanism 10 is actuated to move the block 8 toward the winding drum 7. In response thereto, the holder element 11 is magnetically attracted to the winding peripheral surface 9. At this time, the tape-like solidified body 5 is fixed to the winding peripheral surface 9 as it is carried on the holder element 11, and with this fixed portion of the tape-like solidified body 5 serving as the winding starting end, as shown in FIG. 2, the tape-like solidified body 5 is wound on the winding drum 7.

Figure 3:
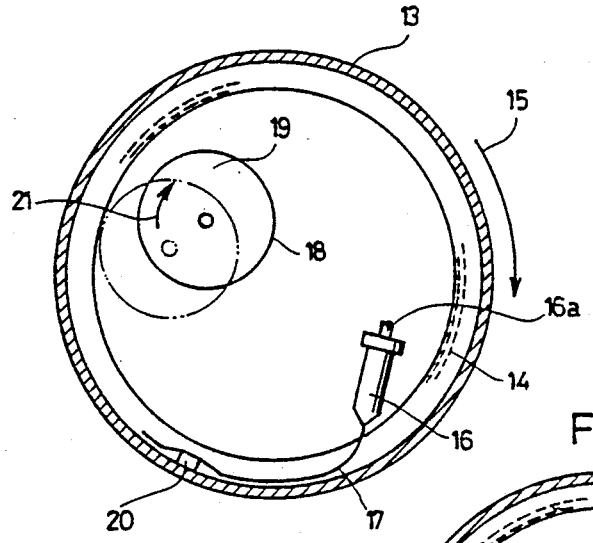
FIGS. 3 to 5 show a second embodiment of the invention, schematically illustrating an apparatus wherein a wire-like solidified object is obtained the "In-Rotating-Water Spinning Method" and is withdrawn.
Figure 4:
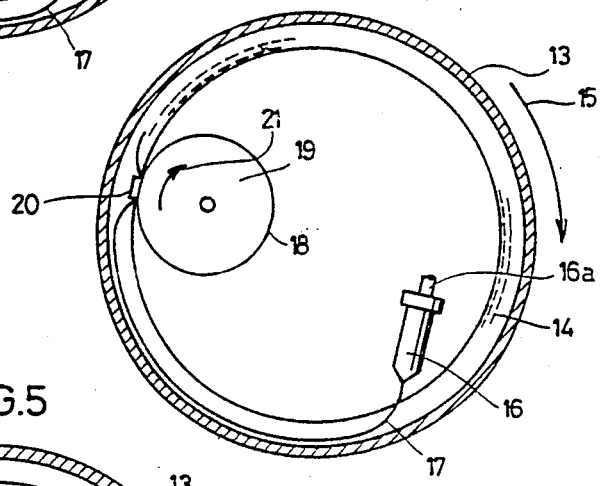
Figure 5:
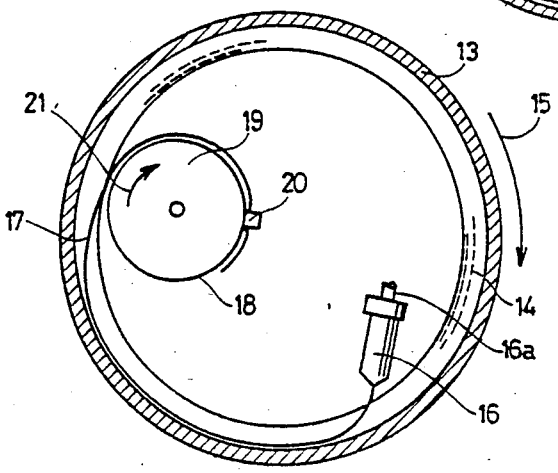

FIGS. 3 to 5 show the invention as applied to the withdrawal of a fine metal wire produced by the "In-Rotating-Water Spinning Method".

For example, as shown in FIG. 3, a cooling liquid 14 is received in a cylindrical rotational drum 13 and forms a liquid layer on the inner peripheral surface of the rotational drum 13 as the cooling liquid 14 is centrifugally held when the rotational drum 13 is rotated in the direction of arrow 15.

Disposed inside the rotational drum 13 is a nozzle 16 for injecting a molten metal into the cooling liquid 14. The nozzle 16 is provided with an unillustrated heater. Further, a pressurized gas is introduced into the nozzle 16 through a conduit 16a. The molten metal injected from the nozzle 16 is quenched for solidification by the cooling liquid 14 to form a wire-like solidified body 17.

In addition, in this embodiment, the rotational drum 13 is made of a non-magnetic material, such as aluminum.

A winding reel 19 having a winding peripheral surface 18 is disposed inside the rotational drum 13 for withdrawing the wire-like or elongated solidified body 17. The winding reel 19 is disposed at a position off center of the rotational drum 13 and has an axis parallel with that of the drum 13. The winding reel 19 is rotated in the same direction as the direction of rotation 15 of the drum 13. The winding peripheral surface 18 has at least a portion thereof made of a ferromagnetic material, such as an iron-type material.

In this embodiment, the winding reel 19 is movable from the solid line position to the phantom line position shown in FIG. 3, whereby the winding peripheral surface 18 can be moved toward the inner peripheral surface of the rotational drum 13.

A magnetically effective element 20 in the form of a permanent magnet is disposed, for example in a free state, on the inner peripheral surface of the rotational drum 13 and is retained on the inner peripheral surface of the drum 13 by the centrifugal force produced with the rotation of the rotational drum 13.

To produce the fine metal wire, that is, wire-like solidified body 17 and withdraw said wire-like solidified body 17, in the initial stage, as shown in FIG. 3, the winding reel 19 is rotated in the direction of arrow 21 at the same peripheral speed as that of the rotational drum 13 and, as shown in solid lines, is disposed at a position relatively remote from the inner peripheral surface of the rotational drum 13. In this state, when the molten metal injected from the nozzle 16, is quenched for solidification in the cooling liquid 14 to start producing the wire-like solidified body 17, the winding reel 19 is moved to the position shown in phantom lines in FIG. 3. On the other hand, a portion of the wire-like solidified body 17 produced in the manner described above rides over the holder element 20.

When the winding reel 19 is moved as described above, the holder element 20 is attracted to the winding peripheral surface 18; thus, as shown in FIG. 4, when the holder element 20 passes close by the winding peripheral surface 18, it is attracted to the winding peripheral surface 18. In response thereto, the wire-like solidified body 17, as carried on the holder element 20, is fixed to the winding peripheral surface 18.

As shown in FIG. 4, when the portion of the wire-like solidified body 17 adjacent the front end thereof is fixed to the winding peripheral surface 18, with the fixed portion serving as the winding starting end the wire-like solidified body 17 is wound on the winding peripheral surface 18, the wire-like solidified body 17 obtained being continuously withdrawn by the winding reel 19, as shown in FIG. 5.

In addition, in the embodiment shown in FIGS. 3 to 5, a plurality of holder elements corresponding to holder element 20 may be distributed on the inner peripheral surface fo the rotational drum 13. This arrangement will make it possible to use a portion of the wire-like solidified body 17 which is closer to its front end as the winding starting end and to fix the wire-like solidified body 17 more reliably to the winding peripheral surface 18.

Further, the holder element 20 may be at least partly embedded in a suitable recess formed on the inner peripheral surface of the drum 13. In this manner, by imposing a kind of restraint on the holder element 20 to prevent it from moving in the direction of rotation of the drum 13 while allowing it to move toward the winding peripheral surface 18, the holder element 20 can be prevented from sliding during the time when the drum 13 is being accelerated.

In both of the embodiments shown in FIGS. 1 and 2 and in FIGS. 3 to 5, the holder elements 11 and 20 are made of a permanent magnet and the winding peripheral surfaces 9 and 18 are made of a ferromagnetic material, such as an iron-type material. However, as shown in FIG. 6 to be presently described, this relation may be reversed so that the holder element is made of a ferromagnetic material while the winding peripheral surface is made of a magnet.

Figure 6:
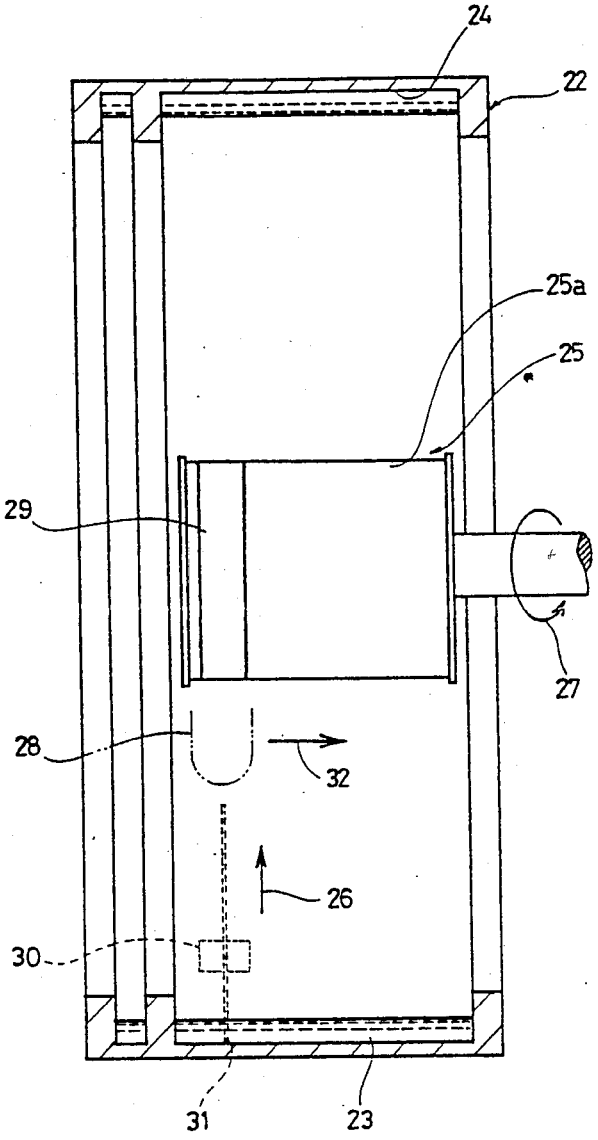
FIG. 6 shows a third embodiment of the invention, schematically illustrating an apparatus a cross-sectional view wherein a wire-like solidified object is obtained by the "In-Rotating-Water Spinning Method" and is withdrawn.

Referring to FIG. 6, a rotational drum 22 to be used is open at opposite ends and is formed on its inner peripheral surface with a groove 24 for holding a cooling liquid 23 which is centrifugally formed into a layer. In the interior of the rotational drum 22, a winding reel 25 is disposed, for example, at the same position as that of the winding reel 19 shown in FIG. 4. The rotational drum 22, when seen on its inner peripheral surface, is rotated in the direction of arrow 26 while the winding reel 25 is rotated in the same direction as the direction of rotation of the rotational drum 22, as shown by an arrow 27, and is given substantially the same peripheral speed.

A nozzle 28 shown in phantom lines is disposed, inside the rotational drum 22 for example, at the same position as that of the nozzle 16 of FIG. 3.

This embodiment is characterized in that a magnet 29 is provided at a leftward position on the winding peripheral surface 25a of the winding reel 25. One such magnet may be used as shown or a plurality of such magnets may be circumferentially distributed. The magnet 29 is made of a permanent magnetic material.

In this embodiment, a magnetically effective holder element 30 shown in dotted, is sunk in a cooling liquid 23. The holder element 30 is made of a ferromagnetic material, such as an iron-type material. In this embodiment, a fine wire, i.e., wire-like solidified body is produced and then withdrawn by the following procedure.

First, the rotational drum 22 and winding reel 25 are rotated at predetermined speeds. Then, the holder element 30 is placed at a position remote from a position adjacent the winding reel 25, on the inner peripheral surface of the drum 22, for preventing the holder element 30 from being attracted to the winding peripheral surface 25*a* before it has arrest the wire-like solidified body. Before the holder element 30 placed in the manner described above, reaches the position adjacent the winding reel 25 as the rotational drum 22 is rotated, a molten material (not shown) is injected. Such molten material is quenched for solidification by entering the cooling liquid 23, thus forming a wire-like solidified body 31 which then rides on the holder element 30. The wire-like solidified body 31 is conveyed together with the holder element 30 in the direction of arrow 26, and the holder element 30 approaches the magnet 29 until there is more than a predetermined amount of magnetic force exerted therebetween, whereupon the holder element 30 is attracted to the winding peripheral surface and the wire-like solidified body 31 and is fixed on the winding peripheral surface 25*a*. Therefore, as the winding reel 25 is rotated, the wire-like solidified body 30 is wound on the winding reel 25.

In addition, in the initial stage of the production of the wire-like solidified body 31, the nozzle 28 is at a leftward position as shown in FIG. 6, and thereafter it is gradually moved in the direction of arrow 32. Therefore, the holder element 30 is placed at a leftward position on the inner peripheral surface, as shown. Correspondingly thereto, the position of the magnet 29 is selected, as described above.

The result of an experiment using the apparatus shown in FIG. 6 is described below.

A1-1 % Si alloy was melted in the nozzle 28, the molten alloy was injected through the nozzle 28, and a wire-like solidified body 31 was obtained in the cooling liquid 31. The diameter of the drum 22 was 600 mm and that of the winding reel 25 was 200 mm; the rotational speed of the drum 22 was 260 rpm and that of the winding reel 25 was 720 rpm; the injection pressure of argon gas was 1.8 $kg/cm^2$; and the nozzle 28 was made of graphite and its orifice diameter was 0.25 mm. Further, the magnet 29 placed on the winding reel 25 had a magnetic flux density of 3400 gauss; there were 18 such magnets arranged at equal intervals circumferentially of the reel 25.

About 1 kg of said alloy was fed to the nozzles 26, and approximately the same amount of wire-like solidified body 31 was wound on the winding reel 25.

In the embodiment shown in FIG. 6 and in the embodiment shown in FIGS. 3 to 5, to attract the holder element 20 or 30 to the winding peripheral surface 18 or 25*a*, the magnetic force of the permanent magnet must be taken into consideration. The magnetic force should be such that the holder element 20 or 30 centrifugally retained on the inner peripheral surface of the rotational drum 1 or 22, is attracted to the winding surface 18 or 25*a* against the centrifugal force and the viscosity resistance of the cooling liquid 14 or 23. For example, the aforesaid experiment conducted in connection with the apparatus shown in FIG. 6 indicated that the magnetic flux density of the magnet 29 was sufficient it it was greater than 2000 gauss.

In each of the embodiments described above, the magnetic force for attracting the holder element to the winding peripheral surface has been a permanent magnet. Thus, the attractive force due to the magnetic force acts between the winding peripheral surface and the holder element all the time and its has been necessary to attract the holder element to the winding peripheral surface only when the long-sized object to be withdrawn is present between the winding peripheral surface and the holder element. To this end, there has been employed a magnetic attraction control means for selectively reducing the distance between the winding peripheral surface 9 or 18 and the holder element 11 or 20 (FIGS. 1 and 2 and FIGS. 3, 4 and 5) or for adjusting the timing for placing the holder element 30 on the inner peripheral surface of the rotational drum 22. However, if the magnetic force for attracting the holder element to the winding peripheral surface is provided by an electromagnet adapted to be switched on or off, a switch for on-off control of said electromagnet can serve as the magnetic attraction control means.

For example, in the apparatus shown in FIG. 6, if the magnet 29 is composed of an electromagnet, then when the holder element 30 with the wire-like solidified body 31 carried thereon approaches the winding peripheral surface 25*a*, the holder element 30 with the wire-like solidified body 31 firmly arrested thereby, is attracted to the winding peripheral surface 25*a* as shown as the electromagnet is turned on.

The above is equally true of the embodiment shown in FIGS. 1 and 2. In FIGS. 1 and 2, if at least a portion of the winding peripheral surface 9 is made of an electromagnet, it is possible to attract the holder element 11 to the winding peripheral surface 9 with the required timing without having to use such a moving means as the pantograph 10.

In the embodiment shown in FIGS. 1 and 2 and the embodiment shown in FIGS. 3 to 5, the winding peripheral surface 9 or 18 may be made of an electromagnet, which is maintained turned on while employing the arrangement for moving the winding peripheral surface 9 or 18 and the holder element 11 or 20 toward each other.

The winding peripheral surface which rotates for winding the elongated object is not limited to a cylindrical peripheral surface represented by a winding drum or winding reel but may be an oblong peripheral surface such as a belt entrained around two parallel rollers.

This invention is widely applicable to the withdrawal of elongated objects such as thin films, thin ribbons and fine wires of metals, alloys, amorphous materials and organic or inorganaic ceramic materials, including the aforesaid tape-like and wire-like solidified objects obtained by quenching for solidification.

We claim:

1. A method of continuously withdrawing an elongated product out of a melt, comprising the following steps:

(a) forming a layer of cooling liquid on an inner peripheral surface of a drum by rotating said drum about a drum axis, (b) providing in said rotatable drum a winding reel having an outer peripheral winding surface and a reel axis extending in parallel to and off-center relative to said drum axis, (c) rotating said winding reel in the same direction as said drum, (d) placing a magnetically effective holder element capable of being magnetically attracted to said winding surface of said winding reel, on said inner peripheral surface of said drum, whereby said magnetically effective holder element is initially retained by centrifugal force on said inner peripheral surface of said rotating drum until said magnetically effective holder element comes sufficiently close to said winding surface of said winding reel, (e) projecting said melt through a nozzle into said layer of cooling liquid for forming and solidifying said elongated product by quenching, (f) positioning a leading end of said elongated product on said magnetically effective holder element for transporting said leading end of said elongated product onto said winding surface of said winding reel, (g) bringing, by the rotation of said drum, said magnetically effective holder element with the leading end of said elongated product placed thereon, sufficiently close to said winding surface of said winding reel to cause a magnetic attraction between said magnetically effective holder element and said winding surface of said winding reel for transferring said magnetically effective holder element and said leading end of said elongated product against said centrifugal force onto said winding surface of said winding reel, (h) securing said leading end of said elongated product to said winding surface of said winding reel by a magnetic force between said magnetically effective holder element and said winding surface of said winding reel, and (i) continuously withdrawing said elongated product from said melt by maintaining the rotation of said drum and of said winding reel.

2. The method of claim 1 comprising making said holder element (11, 20) of a permanent magnet, and making at least a portion of said winding peripheral surface (9, 18) of said winding reel of a ferromagnetic material for cooperation with said permanent magnet.

3. The method of claim 1 comprising making said holder element (30) of a ferromagnetic material, and making at least a portion of said winding peripheral surface (25*a*) of said winding reel of a magnet for cooperation with said ferromagnetic material.

4. The method of claim 1 wherein said step of placing locates said holder element at a position on the inner peripheral surface of said drum sufficiently remote from a position adjacent said winding reel to prevent attraction at the time of placing, and wherein said step of positioning a leading end is performed before said holder element reaches the position adjacent said winding reel where attraction between said holder element and said winding reel takes place.

5. The method of claim 1 wherein causing said magnetic attraction between said holder element and said winding surface of said winding reel, includes moving said winding reel (19) toward the inner peripheral surface of said drum.

6. The method of claim 1 comprising providing said magnetic attraction and said magnetic force by an electromagnet that can be switched on and off.

7. The method of claim 6 further including the step of turningon said electromagnet when said holder element is sufficiently close to said winding surface of said winding reel for said transferring.

8. An apparatus for continuously withdrawing an elongated product out of a melt, comprising a cooling drum rotatably mounted for maintaining a layer of cooling liquid on an inner peripheral surface of said drum when said drum is rotating about a drum axis, a winding reel having an outer peripheral winding surface, said winding reel being mounted inside said cooling drum on a reel axis extending in parallel to and off-center relative to said cooling drum axis for rotation in the same direction as said cooling drum, a magnetically effective holder element capable of being magnetically attracted to said winding surface of said winding reel, said magnetically effective holder element being initially retained on said inner peripheral surface of said cooling drum by centrifugal force when said cooling drum is rotating, nozzle means located inside said cooling drum for directing a stream of said melt into said layer of cooling liquid for solidifying said stream by quenching to form said elongated product, whereby a leading end of said elongated product is positioned on said magnetically effective holder element for transporting said leading end onto said winding surface of said winding reel, and magnetic means on or in said winding surface of said winding reel for attracting said magnetically effective holder element with said magnetically effective holder element passes by sufficiently close to said winding reel for transferring said magnetically effective holder element and said leading end onto said winding surface against said centrifugal force, said magnetic means securing said magnetically effective holder element and thereby also said leading end to said winding surface for a continuous withdrawing operation as long as said cooling drum and said winding reel are rotating.

9. The apparatus of claim 8 wherein said winding peripheral surface has a peripheral speed substantially the same as that of said inner peripheral surface of said cooling drum.

10. The apparatus of claim 8 further comprising magnetic attraction control means for controlling a magnetic force of said magnetic means so that said magnetic force is sufficient to secure said magnetically effective holder element to said winding peripheral surface when said leading end is present between said winding peripheral surface and said holder element.

11. The apparatus of claim 10 wherein a magnetic attraction force is permanently effective between said winding peripheral surface and said magnetically effective holder element, and wherein said magnetic attraction control means comprise means for reducing a distance between said winding peripheral surface and said magnetically effective holder element for transferring said magnetically effective holder element from said inner peripheral surface of said cooling drum to said winding surface of said winding reel.

12. The apparatus of claim 11 wherein said magnetic means of said winding peripheral surface comprise a least a portion of said winding reel made of a ferromagnetic material, and wherein said holder element is made of a permanent magnetic material.

13. The apparatus of claim 11 wherein at least a portion of said winding peripheral surface forms a magnet, and said magnetically effective holder element is made of a ferromagnetic material.

14. The apparatus of claim 10 wherein at least a portion of said winding peripheral surface forms an electromagnet, and said magnetic attraction control means has switch means for on-off controlling said electromagnet.

* * * * *

UNITED STATES PATENT AND TRADEMARK OFFICE

CERTIFICATE OF CORRECTION

PATENT NO. : 4,804,153

DATED : February 14, 1989

INVENTOR(S) : Masanobu Nishio; Kazuo Sawada; Kazuhisa Yamauchi; Saburo Yosimura

It is certified that error appears in the above-identified patent and that said Letters Patent is hereby corrected as shown below:

In [57] Abstract, line 2, replace "from a melt a fine wire" by --a fine wire from a melt--.

In the Claims:

Claim 2, (Column 8, line 30) after "1" insert --,--.
Claim 3, (Column 8, line 35) after "1" insert --,--.
Claim 4, (Column 8, line 40) after "1" insert --,--.
Claim 5, (Column 8, line 49) after "1" insert --,--.
Claim 6, (Column 8, line 54) after "1" insert --,--.
Claim 7, (Column 8, line 57) after "6" insert --,--;
(Column 8, line 58) replace "turningon" by --turning-on--.
Claim 8, (Column 9, line 18) replace "with" by --when--.
Claim 9, (Column 9, line 26) after "8" insert --,--.
Claim 10, (Column 10, line 1) after "8" insert --,--.
Claim 11, (Column 10, line 8) after "10" insert --,--.
Claim 12, (Column 10, line 18) after "11" insert --,--;
(Column 10, line 21) after "said" insert --magnetically effective--.
Claim 13, (Column 10, line 23) after "11" insert --,--.
Claim 14, (Column 10, line 27) after "10" insert -- --

Signed and Sealed this

Eighteenth Day of July, 1989

*Attest:*

DONALD J. QUIGG

*Attesting Officer*

*Commissioner of Patents and Trademarks*